United States Patent [19]

Albinger, Jr. et al.

[11] Patent Number: 4,745,260

[45] Date of Patent: May 17, 1988

[54] AUTOMATIC SWITCHING APPARATUS FOR AN ELECTRIC APPLIANCE

[75] Inventors: Harry Albinger, Jr., Monroe; Thomas M. O'Loughlin, Milford, both of Conn.; Charles A. Balchunas, Apple Valley, Calif.; William D. Ryckman, Jr., Orange, Conn.

[73] Assignee: Black & Decker Inc., Townson, Md.

[21] Appl. No.: 90,389

[22] Filed: Aug. 27, 1987

Related U.S. Application Data

[63] Continuation of Ser. No. 821,274, Jan. 22, 1986, abandoned.

[51] Int. Cl.[4] ..... H05B 1/02; D06F 75/26; H01H 51/10

[52] U.S. Cl. ..... 219/250; 219/240; 219/252; 219/518; 219/492; 38/1 D; 38/74; 307/141.4; 335/175; 361/195; 340/640

[58] Field of Search ..... 219/240, 241, 245, 246, 219/247, 248, 249, 250, 251, 252, 253, 254, 255, 256, 257, 518, 492; 34/1 C, 1 D, 74; 307/116, 119, 132 M, 141, 141.4, 142; 335/173, 174, 175; 340/635, 640, 655; 361/195, 196, 203

[56] References Cited

U.S. PATENT DOCUMENTS

| | | | |
|---|---|---|---|
| 2,109,181 | 2/1938 | Muldowney . | |
| 2,143,701 | 1/1939 | Kelly et al. . | |
| 2,382,587 | 8/1945 | Thomas . | |
| 2,385,606 | 9/1945 | Campbell . | |
| 2,470,532 | 5/1949 | Thomas . | |
| 2,939,939 | 6/1960 | Derden et al. . | |
| 3,424,894 | 1/1969 | Schwartz et al. . | |
| 3,492,459 | 1/1970 | Schwartz et al. . | |
| 3,760,149 | 9/1973 | Harsani . | |
| 4,130,955 | 12/1978 | Baumgartner et al. . | |
| 4,203,101 | 5/1980 | Townsend . | |
| 4,366,366 | 12/1982 | Ekblad . | |
| 4,580,038 | 4/1986 | O'Loughlin | 219/506 |
| 4,595,894 | 6/1986 | Doyle et al. | 335/6 X |

FOREIGN PATENT DOCUMENTS

| | | | |
|---|---|---|---|
| 405531 | 11/1924 | Fed. Rep. of Germany . | |
| 412670 | 4/1925 | Fed. Rep. of Germany . | |
| 1048648 | 1/1959 | Fed. Rep. of Germany . | |
| 1098116 | 1/1961 | Fed. Rep. of Germany . | |
| 1246903 | 8/1967 | Fed. Rep. of Germany . | |
| 44693 | 1/1917 | Sweden . | |
| 2158105 | 11/1985 | United Kingdom | 219/250 |

OTHER PUBLICATIONS

PCT Application No. WO 82/03520 10/14/82 Franklin.
EPO Application No. 84400124.8 Claiming Priority of French Patent Application No. 8301601 2/2/83.
Proctor-Silex Lightweight Electronic Iron with Shut-Off Memory Manual Sunbeam Monitor Electronic Iron Manual.

*Primary Examiner*—M. H. Paschall
*Assistant Examiner*—H. L. Williams
*Attorney, Agent, or Firm*—Perman & Green

[57] ABSTRACT

Automatic switching apparatus for a hand held electrically operated appliance such as a pressing iron. A motion sensor and an electronic timer cooperate to automatically shut off the iron if the iron remains stationary for a predetermined period of time. A simplified mechanism is manually operable in the event the user desires to reactivate the iron. A circuit board mounting simplified electronic circuitry is located within the handle of the iron. An appropriate indicator informs the user whether the iron is in the active mode or in the inactive mode.

23 Claims, 5 Drawing Sheets

AUTOMATIC SWITCHING APPARATUS FOR AN ELECTRIC APPLIANCE

This is a continuation of application Ser. No. 821,274 filed on Jan. 1, 1986, now abandoned.

BACKGROUND OF THE INVENTION

I. Field of the Invention

The present invention relates generally to automatic switching apparatus and, more particularly, to automatic switching apparatus for use with appliances having electronic controls.

II. Description of the Prior Art

The possibility of leaving an electrically operated appliance, such as a pressing iron, turned on and unattended for an extended period of time is a concern to many users. Some top-of-the-line pressing irons now provide the feature of automatic shut-off if the iron is not used for a predetermined period of time. Typically, the feature is included in a complete electronic control system using a microprocessor and an electromagnetic relay or a solid state switch such as a triac to control power to the heating element. Both of these devices are expensive and have other drawbacks as well. A triac, for example, requires a sizeable heat sink to dissipate its power loss when the iron is on and an iron is obviously a poor location for such a device because of the hot environment it represents. A power relay requires a significant amount of power to operate and tends to heat up when it is kept energized in the hot iron environment. Examples of prior art switching apparatus of the general nature just described include a pair of commonly assigned patent applications, namely, Ser. No. 687,842, filed Dec. 31, 1984, of Harry Albinger and Michael J. Marchetti for "Switching Apparatus for an Appliance Control Circuit" and Ser. No. 687,343, filed Dec. 31, 1984, of Thomas M. O'Loughlin for "Indicating and Control Apparatus for an Appliance".

SUMMARY OF THE INVENTION

It was with knowledge of the prior art and the problems existing which gave rise to the present invention. In brief, the present invention is directed towards an automatic switching apparatus for a hand held electrically operated appliance such as a pressing iron. A motion sensor and an electronic timer cooperate to automatically shut off the iron if the iron remains stationary for a predetermined period of time. A simplified mechanism is manually operable in the event the user desires to reactivate the iron. A circuit board mounting simplified electronic circuitry is located within the handle of the iron. An appropriate indicator informs the user whether the iron is in the active mode or inactive mode.

The present invention, as disclosed, represents a simpler and lower cost system according to which power is controlled by a manually closed set of contacts which can be tripped open by a small solenoid. The solenoid is energized by an electronic timing circuit whenever the iron is "on" but not moved for a predetermined time interval, typically, seven to ten minutes. A small mercury switch is mounted so that it opens and closes randomly when moved by the normal ironing motions. Each time the switch opens, the timer is reset to the start of its main cycle so that with normal iron use, the power will never be turned off.

As the cost of electronic circuitry continues to decrease, it has become desirable to provide features for home appliances which were not heretofore economically feasible. Such features include those directed to operating convenience and increased utility as well as features which provide for safer operation of the appliance. The present invention incorporates such features together with a simplified mechanism enabling the user to reactivate the appliance once it has been turned off for lack of use.

One feature of the present invention is that no energy is expended in a separate system to keep the iron energized. That is, unlike some known constructions, which require the continuous application of electricity for operating relays and the like to open and close contacts, and resulting in the further generation of non-usable heat, the invention relies on operator energy to actuate a button to return the iron to the power mode. Furthermore, only a momentary flow of electricity is required to convert the iron to the dormant mode in the event the iron remains inactive for the seven to ten minute time interval mentioned above.

Other and further features, objects, advantages, and benefits of the invention will become apparent from the following description taken in conjunction with the following drawings. It is to be understood that both the foregoing general description and the following detailed description are exemplary and explanatory but not restrictive of the invention. The accompanying drawings, which are incorporated in, and constitute a part of this invention, illustrate some of the embodiments of the invention and, together with the description, serve to explain the principles of the invention in general terms.

DESCRIPTION OF THE PREFERRED EMBODIMENTS

Figure 1:
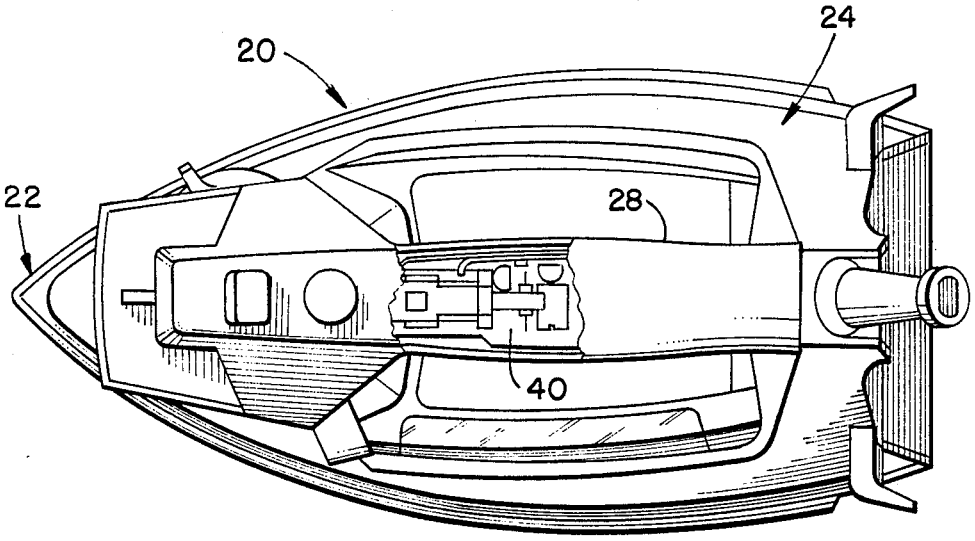
FIG. 1 is a top plan view, certain parts being cut away, illustrating an electrical appliance in the form of a pressing iron embodying the invention.
Figure 2:
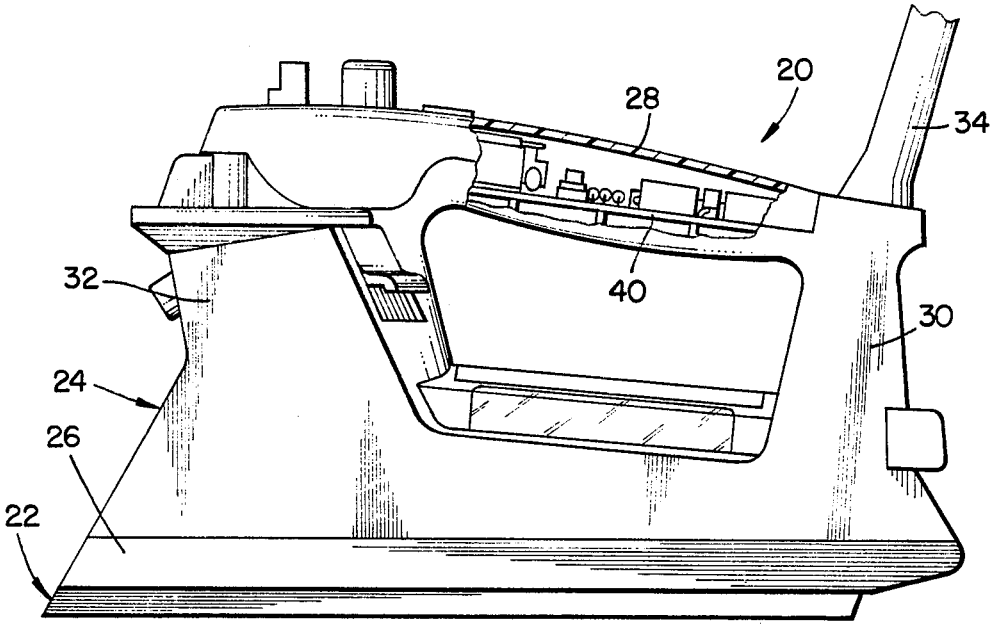
FIG. 2 is a side elevation view, certain parts being cut away and in section, of the pressing iron illustrated in FIG. 1.

Turn now to the drawings and initially to FIGS. 1 and 2 which illustrate an electric pressing iron 20 which includes a sole plate 22, typically of cast aluminum, on which is mounted a housing 24, typically of molded plastic. The housing 24 includes a bottom portion or skirt 26 and a handle portion 28 connected by a rear pedestal 30 and a throat 32. Extending from the rear of the handle portion 28 and the top of the pedestal 30 is a line cord 34 for connecting the iron to a source of power. A number of user controls including a temperature selector knob, steam actuator, and steam control button may be provided on the housing 24 but constitute no part of the present invention and thus will not be discussed.

Figure 3:
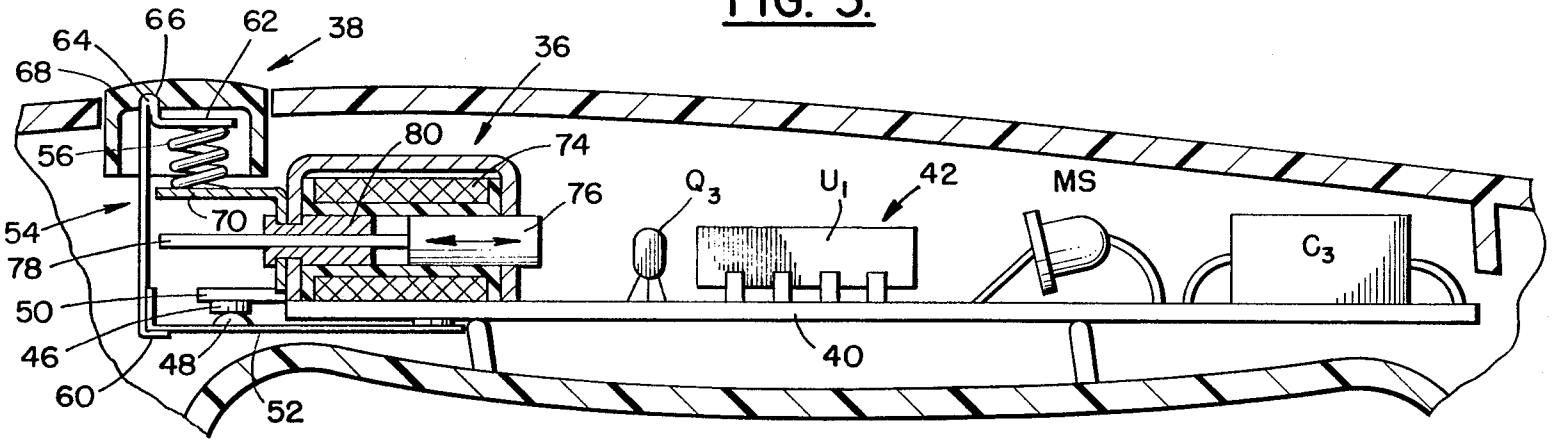
FIG. 3 is a detail elevation cross section view illustrating a portion of the appliance depicted in FIGS. 1 and 2.
Figure 4:
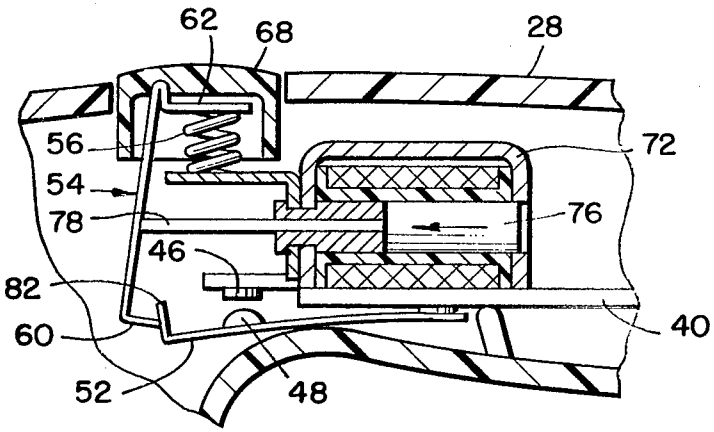
FIGS. 4 and 5 are further detail views in cross section, similar to FIG. 3, and illustrating successive positions of a reset mechanism utilized by the invention.

Turn now to FIG. 3 which illustrates at the left side, that is, the front of the handle portion 28, a pair of mechanisms, namely a solenoid mechanism 36 and a reset mechanism 38. These mechanisms are mounted on the front end of the printed circuit board 40 upon which is also mounted an electronic timing circuit 42 including an electronic timer $U_1$ and a motion detector switch MS. The specifics of the electronic timing circuit will be described below. A pair of contacts 46 and 48 are connected in series with one power line extending between the line cord 34 (FIG. 2) and all of the electrical or electronic circuits in the iron 20. The contact 46 is mounted to a fixed blade 50 which is riveted or otherwise secured to the circuit board 40. The contact 48 mounted on a flexible blade 52 which is biased such that, unless otherwise restrained, the contacts will be moved to an open position as illustrated in FIG. 4.

A latch 54 serves to hold the contacts closed, the upward force exerted by a compression spring 56 accomplishing this result. Specifically, the latch 54 comprises a downwardly extending leg 58 (FIG. 5) terminating at a foot 60 which is engageable with the undersurface of the flexible blade 52. The latch 54 also includes a generally horizontally extending head member 62 which intersects with the leg 58 at an upwardly projecting pivot bearing 64 (FIG. 3). The pivot bearing 64 is received in a groove 66 formed in an underside of the reset button 68. The compression spring 56 extends between a spring support platform 70 cantilevered from the support structure for the solenoid mechanism 36 and the head member 62.

The solenoid mechanism 36 comprises a housing or frame 72 suitably mounted on the printed circuit board 40. The housing 72 encompasses a coil 74 which, when energized, drives an armature 76 to the left as seen in FIG. 3. A free floating rod 78 is mounted for reciprocation in a bushing 80 supported on the housing 72 and is coaxial with the armature 76. When the coil 74 is energized, the armature 76 moves to the left, pushing the leg 58 of the latch 54 also to the left (FIG. 4). In this manner, the foot 60 moves out from under the flexible blade 52, thus allowing the contacts 46 and 48 to open. The contacts are then held open by the flexible blade 52. When the solenoid is de-energized, the foot 60 is held against the nose 82 by the bias of the compression spring 56 acting on the latch 54.

Figure 5:
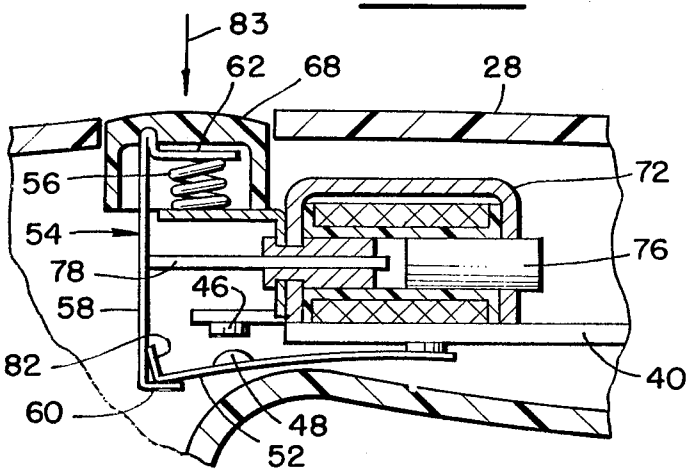

To reenergize the iron, the reset button 68 is depressed as indicated by an arrow 83 in FIG. 5 to a position somewhat below the position illustrated in FIGS. 3 and 4. The latch 54, and specifically the foot 60, slides down the front portion of the nose 82 and is drawn under the extreme end of the flexible blade 52 by the spring 56 acting on the head member 62.

At this stage of operation, the coil 74 is not energized which leaves the armature 76 and rod 78 free to move axially in a direction away from the latch 54. As illustrated in FIG. 5, the leg 58, in returning to its latched position, pushes the rod 78 and therefore the armature 76 toward the right. When the user releases the button 68, the spring 56 raises the button, and with it the latch 54, until the contacts 46 and 48 again close to the position illustrated in FIG. 3, thereby again energizing the iron.

It is noteworthy that in this embodiment the contacts 46 and 48 cannot be held closed by holding the button 68 down. This is for the reason that depressing the button allows the contacts to open. Even if the button is jammed in its normal position, the switch will still trip open when the coil is energized.

Figure 6:
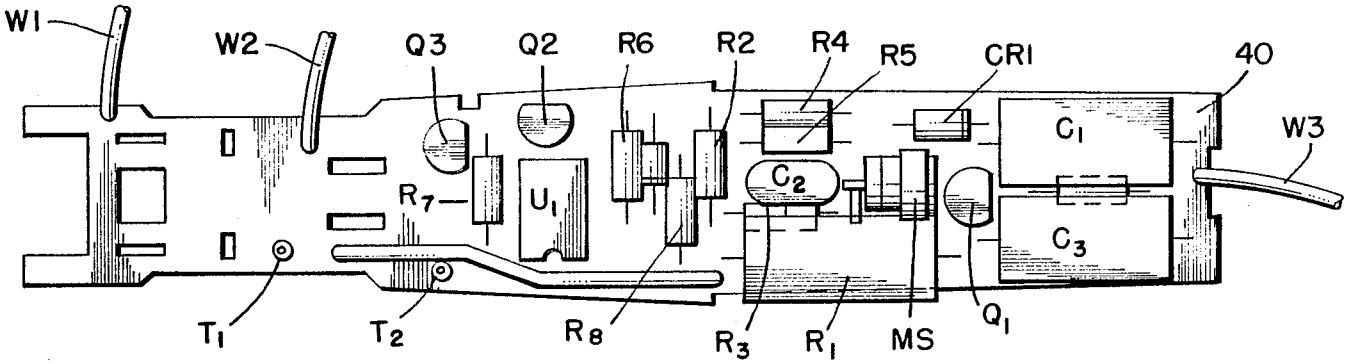
FIG. 6 is a top plan view of a circuit board utilized by the invention and illustrating the relative positioning of the electronic components thereon.
Figure 7:
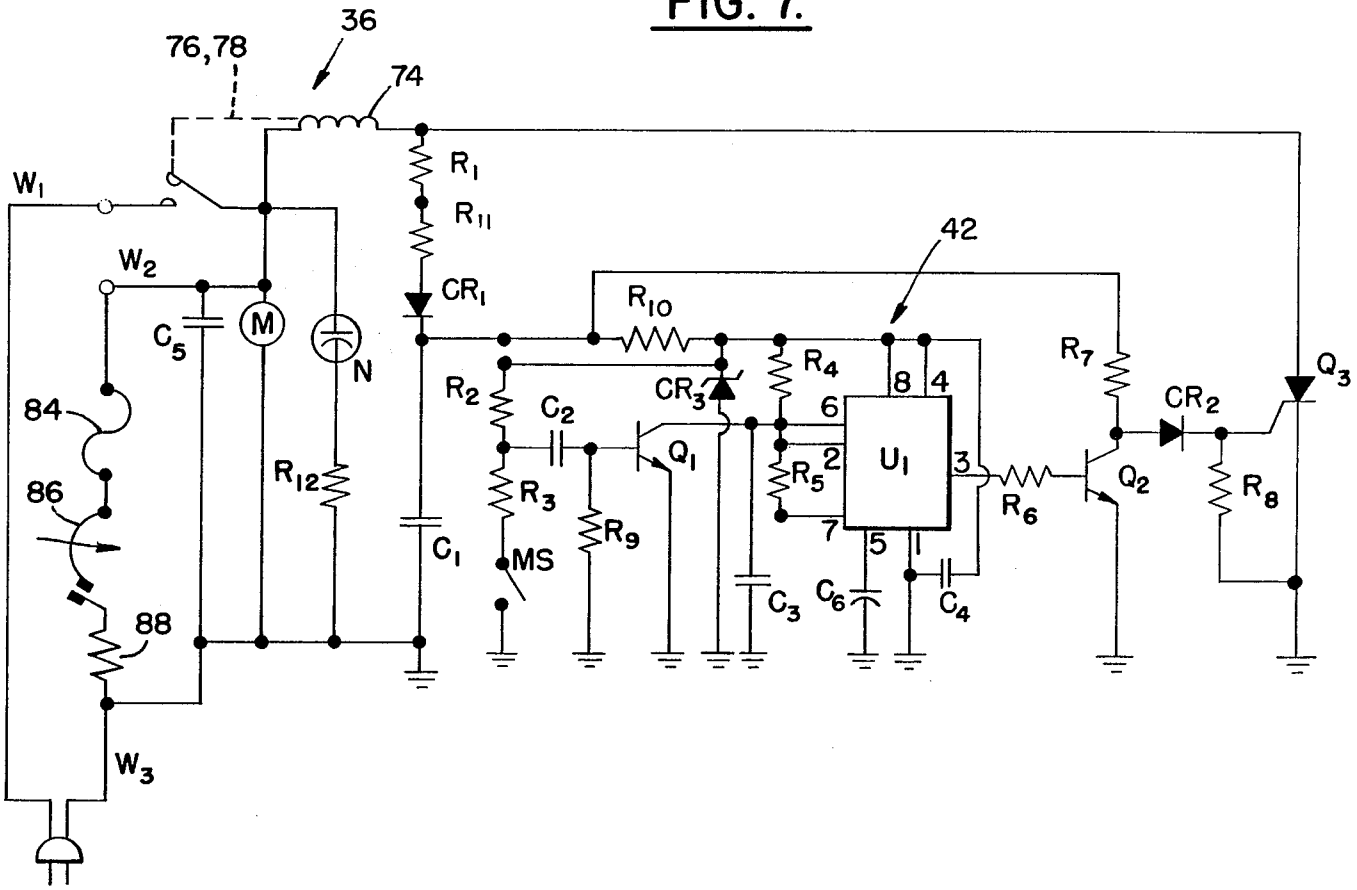
FIG. 7 is a schematic drawing of a typical electronic circuit utilized by the invention.

Turn now to FIGS. 3, 6 and 7. The electronic control circuitry is physically illustrated in FIG. 6 and is schematically illustrated in FIG. 7. Power is controlled by the manually closed set of contacts 46 and 48 which, as just described, can be tripped open by the small solenoid mechanism 36. The coil 74 of the solenoid mechanism is energized by the electronic timing circuit 42 (FIG. 7) whenever the iron is "on" but not moved for a predetermined time interval. This time interval is typically seven to ten minutes, but can be of any desired duration. A small motion detector switch MS, which may be a mercury switch, is mounted on the circuit board 40 such that it opens and closes randomly when moved by normal ironing motions. Each time the switch opens, the electronic timer $U_1$, is reset to the start of its timing cycle so that with normal iron use the power will never be turned off.

Referring now particularly to FIG. 7, a power lead $W_1$ is connected to the reset switch represented by the contacts 46 and 48 (see FIG. 3–5), a single pole switch which is closed to a latched closed condition, as previously described, by manually depressing the reset button 68. This reset switch then remains closed until tripped open by the solenoid coil 74 being energized, also as previously described. From the reset switch represented by the contacts 46 and 48, power proceeds through a power lead $W_2$ to an over temperature limiter 84, a thermostat 86, and a calrod heating element 88 which are all the same as in conventional irons. The other calrod terminal is connected to a power lead $W_3$ and is also the "common" circuit for the electronic circuitry. A capacitor $C_5$ and a metal oxide varistor M, one example being a General Electric V130LA2 MOV, are added across the power leads $W_2$ and $W_3$ for transient suppression.

Whenever the contacts 46 and 48 are closed, the user is informed that the iron is "on" by the illumination of a neon bulb N, current flow through which is limited by a resistor $R_{12}$ in series therewith. With the contacts 46 and 48 closed, power is also supplied to the electronic circuitry. The resistors $R_1$ and $R_{11}$, diode $CR_1$ and capacitor $C_1$ form a d.c. power supply providing approximately +11 volts across the capacitor $C_1$. This voltage is reduced and regulated at 9.1 volts by the resistor $R_{10}$ and the zener diode $CR_3$. An integrated circuit timer $U_1$ is used to time the seven to ten minute turn off delay. An acceptable form of the circuit timer $U_1$ is a TLC555C integrated circuit timer manufactured and sold by Texas Instruments, or equivalent. The capacitor $C_3$ is continually being charged through the resistor $R_4$ and since no base current is supplied to the transistor $Q_1$, the transistor $Q_1$ is "off" and does not discharge the capacitor $C_3$. The seven to ten minute interval is determined by the time required to charge the capacitor $C_3$ to two-thirds the voltage at pins 4 and 8 of the timer $U_1$.

The motion detector switch MS, a small mercury switch, as noted above, is normally closed and capacitor $C_2$ is charged to approximately 4.5 volts. An acceptable version of the motion detector switch suitable for purposes of the invention is model TS66 sold by Fifth Dimension, Inc. of Clinton, N.J. When the iron 20 is moved, as in normal ironing motion, the motion switch MS opens momentarily and capacitor $C_2$ starts to charge towards approximately 9 volts through the resistor $R_2$. This charge current is also base to emitter current in transistor $Q_1$ so that the transistor $Q_1$ is turned on, momentarily, thereby discharging capacitor $C_3$ and thus resetting the timer $U_1$. When the motion switch MS recloses, capacitor $C_2$ is partially discharged again through the resistor $R_3$, the motion switch MS, and resistor $R_9$, and the transistor $Q_1$ is again turned "off".

The timer $U_1$ is connected as a astable oscillator having its output at pin 3 "high" (approximately 9 volts) for seven to ten minutes followed by several milliseconds "low" (approximately 0.1 volts) depending upon $C_3/R_5$ discharge timing. Resistor $R_5$ determines the rate at which capacitor $C_3$ is discharged when the circuit times out because the iron has not been used for 7 to 10 minutes. This insures that the SCR will be turned on long enough to always trip the solenoid actuated switch. The transistor $Q_2$ inverts this voltage from pin 3 of the timer $U_1$ so that its collector is at a low voltage when pin 3 is high and high when pin 3 goes low at the end of the timing period. In this context, resistor $R_6$ is the biasing resistor for transistor $Q_2$ when pin 3 is high thereby limiting the base current of transistor $Q_2$ to a safe value. When the collector of the transistor $Q_2$ goes "high", the diode $CR_2$ conducts enough current through resistor $R_7$ to resistor $R_8$ and to the gate of an SCR $Q_3$ to cause the SCR gate to turn "on" during positive half cycles of voltage on the power lead $W_1$. Resistor $R_7$ biases the gate of SCR $Q_3$ and limits the collector current to transistor $Q_2$ to a value that enables the charge on capacitor $C_1$ to last long enough to insure that the solenoid 36 will trip the switch. Heavy current pulses then flow through the solenoid coil 74 causing it to trip the reset switch contacts 46 and 48 to an open position which removes power from the iron heating circuit and from the control circuit.

Capacitors $C_4$ and $C_6$ increase the noise immunity of the timer $U_1$ as is well known. Also, a resistor $R_8$ stabilizes the gate of SCR $Q_3$ so that voltage withstand and dv/dt characteristics are improved.

Thus it will be appreciated that the mechanism described is a simple, low cost, low power, manually closed but electrically tripped open switching device which is ideally suited for electrical appliances such as a pressing iron. The energy to close and open the electrical contacts and the contact holding force and weld breaking force are all supplied by the user in pushing the reset button 68. Only a momentary current is used to trigger the device and allow a previously stressed spring, namely the flexible blade 52, to open the power switching contacts 46 and 48.

Figure 8:
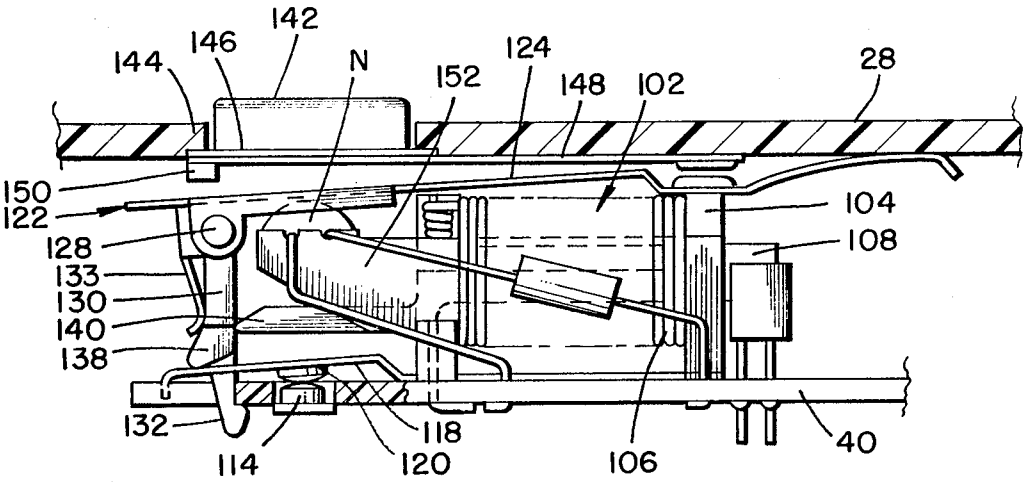
FIG. 8 is a detail elevation cross section view similar to FIG. 3 and depicting another embodiment of the invention.

Another, and preferred, embodiment of the mechanism of the invention will now be described with reference to FIGS. 6–11. The circuit board 40 supporting all of the electronic components previously described is suitably mounted in the handle portion 28 of the iron 20. As seen in FIG. 8, a solenoid mechanism 102 is mounted on the circuit board 40 and includes a plastic chassis or coil bobbin 104, a coil 106, and an armature 108 which moves to the left (FIG. 8) when the coil 106 is energized.

Figure 9:
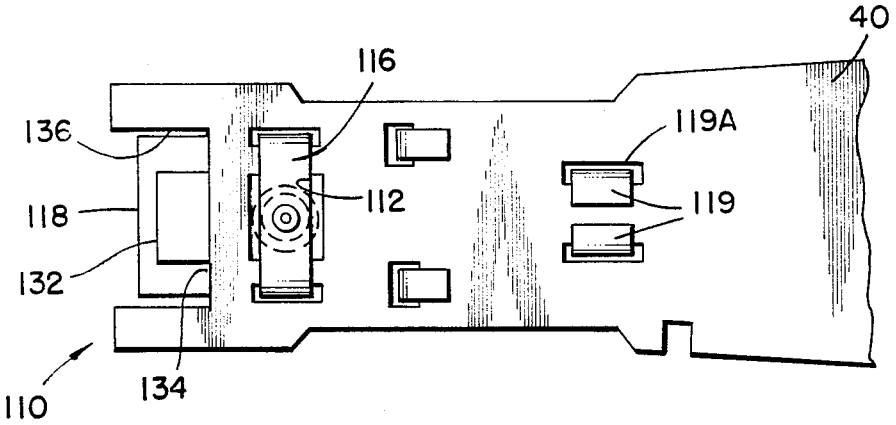
FIG. 9 is a detail bottom plan view of the embodiment depicted in FIG. 8.
Figure 10:
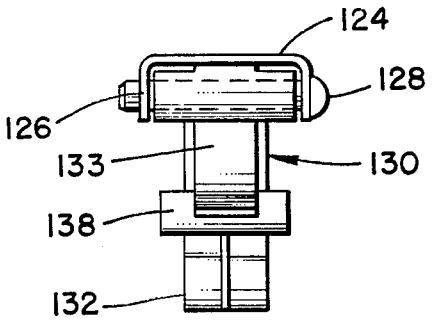
FIG. 10 is a detail front elevation view of parts illustrated in FIG. 8.

Just inboard from an end 110 of the circuit board 40 is an opening 112 (FIG. 9) through which a stationary contact 114 extends, mounted on a suitable support 116 which is suitably fixed to the circuit board. A flexible blade 118 is bifurcated at a forward end and has a pair of tabs 119 at a rearward end received through openings 119A in the circuit board (FIG. 9). The tabs 119 ae bent over and engage the circuit board to affix the blade thereto. The blade 118 extends forwardly and has mounted thereon a movable contact 120 which is engageable with the stationary contact 114. However, the flexible blade 118 is formed of a suitable spring material biased so that the contacts 114 and 120 are normally separated unless forced together by an outside influence.

Figure 11:
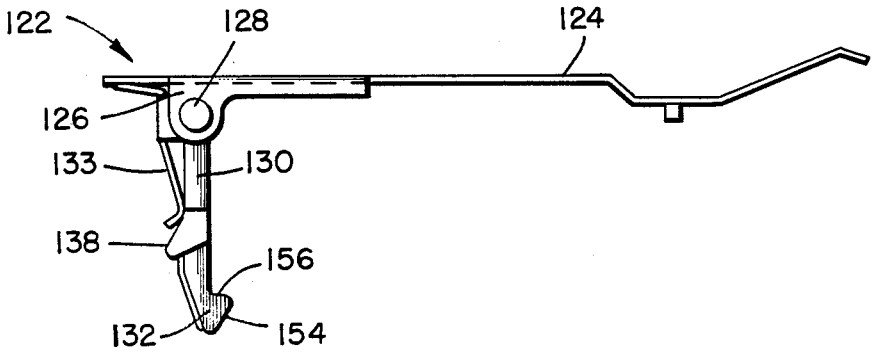
FIG. 11 is a detail side elevation view of the construction illustrated in FIG. 10.

Such an outside influence is in the form of a latch 122. The latch 122 includes an elongated latch release spring 124 mounted at its rear end to the bobbin 104 of the solenoid mechanism 102 and biased upwardly. Near its forwardmost end, the latch release spring 124 has a pair of depending wings 126 which are suitably pierced to receive a transversely extending bearing pin 128 for pivotally mounting thereon a downwardly extending latch lever 130. At a lower extremity of the latch lever 130 is a foot 132 which is releasably engageable with an edge 134 in a recessed region 136 at the end 110 of the circuit board 40. A latch spring 133 is also mounted on the pin 128, with one end bearing against the latch release spring 124 and the other end against the latch lever 130 to urge the latter in a counterclockwise direction (FIGS. 8 and 11). Spaced above the foot 132 and integral with the latch lever is a lobe 138 which is engageable with an upper surface of the flexible blade 118. A non-magnetic extension 140, preferably of molded plastic material, at the forward end of the armature 108 is engageable with a rear surface of the latch lever 130 and is selectively operable to move the foot 132 out of engagement with the edge 134.

A reset button 142 extends through an opening 144 in the handle portion 28. A peripheral flange 146 on the button 142 is engageable with the opening 144 and restrains the button against further upward travel. Since the reset button 142 is mounted on the upper surface of a button retainer spring 148, it is, in effect, captured in place on the handle portion 28. The retainer spring 148 is suitably fastened to the handle portion 28 far to the rear of the reset button 142 and at its forward end, the button 142 is provided with a hammer 150 which is engageable with an upper surface of the latch release spring 124.

The neon lamp N is illustrated as being suitably mounted on a support 152 fixed to the bobbin 104 or other structure within the handle portion 28. The reset button is fabricated from a translucent material and the neon lamp N is positioned beneath the reset button so as to create a glow in the surface of the reset button when the lamp is turned on.

As previously explained, after the iron 20 has remained motionless for the predetermined period of time, for example, 7 to 10 minutes, as previously described, a pulse of electrical energy is directed via the electronic circuit to the coil 106. The pulse is only momentary, no greater than one second in duration, and typically less than 50 milliseconds in duration. When the coil is thereby energized, the armature 108 is magnetically moved forward (to the left in FIG. 8) toward the center of the coil 106 where the magnetic lines of force are concentrated and the strongest.

The non-magnetic molded extension 140 thereby engages the latch lever 130 pushing it forward against the bias of the latch spring 133 to unlatch the foot 132 from the front edge 134 of the printed circuit board 40. The force of the upward biased latch release spring 124 moves the latch lever 130 upwardly and with it the latch spring 133. Motion is also aided by the upward bias of the flexible blade 118 which moves upward upon release of the foot 132 and opens the switch contacts 114 and 120 to turn off power to the iron.

To restore power to the iron, the user pushes the reset button 142. With the downward motion of the reset button, the latch lever 130 is moved downwardly and with the rearward bias of the latch spring 133, the foot 132 engages the edge 134 of the printed circuit board 40. A cam surface 154 on the foot 132 slides along the edge 134 until a shoulder 156 is reached which allows the latch lever to pivot rearwardly (counterclockwise in FIG. 11) such that the shoulder 156 firmly engages the undersurface of the printed circuit board. Thus, once again, the contacts 114 and 120 are closed to restore power to the iron. The contacts remain closed until the coil is again energized. The neon lamp N, being connected in parallel with the control and power circuits, is lighted when the contacts 114 and 120 are engaged. In an opposite fashion, when the contacts 114 and 120 are open, the neon lamp is turned off.

While a preferred embodiment of the invention has been disclosed in detail with specific values recited for certain of the electronic components for greater understanding, it should be understood by those skilled in the art that various modifications may be made to the illustrated embodiment without departing from the scope of the invention as described in the specification and defined in the appended claims.

We claim:

1. Automatic switching apparatus for a hand held electrically operated appliance comprising:

switch means convertible between a power mode for electrically connecting the appliance to a source of electrical power and a dormant mode for electrically disconnecting the appliance from the source of electrical power;

electromechanical means which is normally deenergized but operable when energized for converting said switch means to the dormant mode;

a motion sensor responsive to movement of the appliance for generating a signal;

timer means timing a preset period time responsive to the signal from said motion sensor for re-setting the preset period of time and energizing said electromechanical means upon lapse of said preset period of time; and manually operable mechanical reset means to selectively convert said switch means to the source of electrical power independent of movement of the appliance.

2. An automatic switching apparatus as set forth in claim 1 wherein said timer means is responsive to the latest in a series of signals from said motion sensor for re-initiating a timing sequence before completion of said preset period of time and for energizing said electromechanical means upon uninterrupted completion of said preset period of time.

3. An automatic switching apparatus as set forth in claim 2 wherein said timer means includes an electronic timing circuit.

4. An automatic switching apparatus as set forth in claim 1 wherein said reset means includes:

latch means maintaining said switch means in the power mode.

5. An automatic switching apparatus as set forth in claim 1 wherein said switch means includes:

first and second mutually engageable contacts; and blade means biasing said second contact away from engagement with said first contact; and wherein said reset means includes: latch means releasably engageable with said blade means for holding said first and second contacts mutually engaged.

6. An automatic switching apparatus as set forth in claim 5 wherein said electromechanical means includes:

an actuating member movable between a retracted position distant from said latch means and an advanced position engaged with said latch means and effective to move said latch means to a position disengaged from said blade means thereby causing said first and second contacts to disengage; and an electromagnetically driven armature for moving said actuating member to said advanced position, said armature being movable between a retracted position and an advanced position in engagement with and holding said actuating member in said advanced position.

7. An automatic switching apparatus as set forth in claim 6 wherein said armature is a solenoid plunger and said actuating member a rod coaxially aligned therewith.

8. Automatic switching apparatus as set forth in claim 1 including:

indicator means electrically connected to said switch means for indicating when said appliance is in the power mode.

9. Automatic switching apparatus as set forth in claim 8 wherein said indicator means is a lamp.

10. Automatic switching apparatus as set forth in claim 1 wherein said electromechanical means is momentarily operable.

11. Automatic switching apparatus as set forth in claim 10 wherein mementarily operable is intended to mean operation for a duration of up to one second in time.

12. An automatic switching apparatus as set forth in claim 1 wherein said reset means includes:

latch means operable in one condition for maintaining said switch means in the power mode and operable in another condition for allowing said switch means to assume the dormant mode; and wherein said electromechanical means includes:

a momentarily operable release means engageable with said latch means to move said latch means from said one condition to said other condition.

13. An automatic switching apparatus as set forth in claim 12 wherein said release means includes:

a solenoid; and an armature operably associated with said solenoid being movable between a retracted position and, upon momentary actuation of said solenoid, an advanced position in engagement with said latch means.

14. An automatic switching apparatus for a hand held electrically operated appliance comprising:

switch means including first and second mutually engageable contacts movable between a closed position for electrically connecting the appliance to a source of electrical power and an open position for electrically disconnecting the appliance from the source of electrical power, said switch means including blade means biasing said second contact away from engagement with said first contact;

manually operable mechanical reset means to selectively re-connect the appliance to the source of electrical power independent of movement of the appliance including a latch member releasably engageable with said blade means for holding said first and second contacts mutually engaged; and electromechanical means which is normally deenergized but operable when energized for moving said first and second contacts to the open position including an actuating rod movable between a retracted position distant from said latch member and an advanced position engaged with said latch member and effective in the advanced position to move said latch member to a position disengaged from said blade means thereby causing said first and second contacts to disengage, and an armature for moving said actuating rod to the advanced position, said armature being movable between a retracted position and an advanced position in engagement with and holding said actuating rod in said advanced position.

15. An automatic switching apparatus as set forth in claim 14 wherein said armature and said actuating rod are coaxially aligned.

16. An automatic switching apparatus as set forth in claim 14 wherein said reset means includes:

a button member having a head portion with an outer press surface and an integral sidewall defining an inner cavity with an elongated depression formed in an inner surface of said head portion;

said latch member including first and second transversely extending legs intersecting at an outwardly projecting bight portion, said first leg positioned within said head portion and extending generally parallel to said inner surface and contiguous therewith, said bight portion pivotally received within said elongated depression, and said second leg extending away from said button member and terminating at a transversely extending foot biased into engagement with said blade means;

and resilient means engageable with said first leg urging said latch member and said button member in a direction such that said foot, in engagement with said blade means, causes said first and second contacts to move to the closed position.

17. An automatic switching apparatus as set forth in claim 16 wherein said blade means includes:

a flexible arm and an upturned nose element at an extremity thereof, said foot being engageable with said flexible arm to hold said first and second contacts in the closed position;

said actuating rod in said advanced position being engaged with said second leg to move said foot out of engagement with said flexible arm and into engagement with said upturned nose element to allow said first and second contacts to be held in the open position until said button member is pressed against the bias of said resilient means to move said latch until said foot again moves into engagement with said flexible arm and said resilient means acting through said latch member and against the bias of said flexible arm again moves said contacts into mutual engagement.

18. An automatic switching apparatus as set forth in claim 14 wherein said reset means includes:

a button assembly including a reset button having an outer press surface extending through an opening in a handle of the appliance and restrained against outward movement;

said latch member including:

a latch release spring mounted within the handle aft of the opening and extending forward so as to underlie said button assembly;

a circuit board mounted within the handle supporting said electromagnetic means thereon and having an undersurface and an edge at a forward end thereof;

a stationary contact fixed on said circuit board;

said blade means including a flexible blade having one end fixed on said circuit board and having a movable contact fixed on a movable portion thereof, said movable contact being aligned for engagement with said stationary contact, said flexible blade being normally biased such that said movable contact is spaced from said stationary contact but movable to cause engagement of said movable contact with said stationary contact;

a latch lever pivotally mounted to said latch release spring and depending therefrom, said latch lever having a rearwardly extending foot at its lowermost end, said foot having a cam surface selectively engageable with said forward edge of said circuit board and terminating at a locking shoulder engageable with said undersurface of said circuit board, said latch lever being movable on said latch release spring between a raised position whereat said foot is raised above said circuit board and a lowered position whereat said locking shoulder is engaged with said undersurface of said circuit board;

a downwardly extending latch spring integral with said latch release spring engageable with said latch lever to urge said latch lever to pivot rearwardly;

said button assembly including a resilient support urging said reset button toward an inactive position but being movable downwardly against the bias of said support to an active position whereat said button assembly is engaged with said latch release spring, continued downward movement of said button assembly causing said cam surface to engage said forward edge of said circuit board until said shoulder engages said undersurface of said circuit board, with said latch spring urging said latch lever rearwardly into engagement with said edge at said forward end of said circuit board.

19. An automatic switching apparatus as set forth in claim 18 wherein said resilient support includes:

a retainer spring mounted within the handle distant from the opening and underlying the opening and supporting said reset button thereon.

20. An automatic switching apparatus as set forth in claim 18 wherein said latch lever includes an integral laterally extending lobe thereon spaced above said foot and engageable with said flexible blade to hold said movable and stationary contacts in engagement when said shoulder engages said undersurface of said circuit board.

21. Automatic switching apparatus as set forth in claim 14 including:

indicator means electrically connected to said switch means for indicating when said appliance is in the power mode.

22. Automatic switching apparatus as set forth in claim 21 wherein indicator means is a lamp.

23. An electric pressing iron comprising:

a sole plate;

a handle:

a heating element for heating said sole plate;

an electrical circuit for connecting said heating element to a source of electrical power;

said circuit including:

switch means convertible between a power mode for electrically connecting said heating element to a source of electrical power and a dormant mode for electrically disconnecting said heating element from the source of electrical power;

electromechanical means which is normally deenergized but operable when energized for converting said switch means to the dormant mode;

a motion sensor responsive to movement of the appliance for generating a signal;

timer means timing a preset period of time responsive to the signal from said motion sensor for resetting the preset period of time and for energizing said electromechanical means upon lapse of said preset period of time; and manually operable mechanical reset means to selectively convert said switch means to the source of electrical power independent of movement of the appliance.

* * * * *